US008299001B1

(12) United States Patent
Martin de Julian et al.

(10) Patent No.: US 8,299,001 B1
(45) Date of Patent: Oct. 30, 2012

(54) PROCESS FOR RECOVERING USED LUBRICATING OILS USING CLAY AND CENTRIFUGATION

(76) Inventors: Pablo Martin de Julian, Caracas (VE); Leonardo Ramon Padrino Torres, Caracas (VE); Pedro Adolfo Torres Fonseca, La Victoria (VE)

( * ) Notice: Subject to any disclaimer, the term of this patent is extended or adjusted under 35 U.S.C. 154(b) by 0 days.

(21) Appl. No.: 13/525,262

(22) Filed: Jun. 15, 2012

Related U.S. Application Data

(63) Continuation-in-part of application No. 12/731,366, filed on Mar. 25, 2010, which is a continuation-in-part of application No. 11/856,813, filed on Sep. 18, 2007, now abandoned.

(30) Foreign Application Priority Data

Sep. 18, 2006 (VE) ..... 02147-06

(51) Int. Cl.
*C10M 175/00* (2006.01)

(52) U.S. Cl. ..... 508/111

(58) Field of Classification Search ..... 208/183, 208/13; 508/111
See application file for complete search history.

(56) References Cited

U.S. PATENT DOCUMENTS

| | | | |
|---|---|---|---|
| 3,625,881 | A | 12/1971 | Chambers et al. |
| 3,639,229 | A | 2/1972 | Brownawell et al. |
| 3,819,508 | A | 6/1974 | Fainman et al. |
| 3,919,076 | A | 11/1975 | Cutler et al. |
| 3,930,988 | A | 1/1976 | Johnson |
| 4,033,859 | A | 7/1977 | Davidson et al. |
| 4,383,915 | A | 5/1983 | Johnson |
| 4,502,948 | A | 3/1985 | Tabler |
| 5,112,479 | A | 5/1992 | Srimongkolkul |
| 5,288,413 | A | 2/1994 | Chu |
| 5,759,385 | A | 6/1998 | Aussillous et al. |
| 5,968,370 | A | 10/1999 | Trim |
| 2002/0166794 | A1 | 11/2002 | Bronshtein et al. |
| 2006/0000787 | A1 | 1/2006 | Galasso, III et al. |

FOREIGN PATENT DOCUMENTS

| | | | |
|---|---|---|---|
| CA | 2095564 | * | 11/1993 |
| FR | 2 690 924 | A1 | 11/1993 |
| JP | 2-4898 | A | 1/1990 |

OTHER PUBLICATIONS

James Stetter Owen, Jr., Clay Amended Soilless Substrates: Increasing Water and Nutrient Efficiency in Containerized Crop Production (2006) Dissertation, North Carolina State University, Raleigh, North Carolina.

* cited by examiner

*Primary Examiner* — James Goloboy
*Assistant Examiner* — Chantel Graham
(74) *Attorney, Agent, or Firm* — Swift & Swift; Stephen Christopher Swift

(57) ABSTRACT

A process for recovering used industrial and motor lubricating oils. In a first embodiment (for used industrial oils), the used lubricating oil is mixed with clay in a reactor. The mixture is preferably heated to between 105 and 200 degrees Celsius. The temperature should not be too great, to avoid "cracking" the oil (i.e., breaking molecular chains in the oil). After a certain period of time, the mixture is pumped through filters. Cakes of clay and contaminants remain in the filters, while the oil emerges without the contaminants. A second embodiment (for removing ash or soot, very fine carbon particles and other organic compounds from used motor oils) is the same as the first embodiment, except that before the mixture is passed through the filters, a centrifuge is used to remove most of the clay contaminated with soot, so that it will not block the filters.

20 Claims, 2 Drawing Sheets

PROCESS FOR RECOVERING USED LUBRICATING OILS USING CLAY AND CENTRIFUGATION

CROSS REFERENCE TO RELATED APPLICATIONS

This application is a Continuation-In-Part of U.S. patent application Ser. No. 12/731,366, filed on Mar. 25, 2010, which was a Continuation-In-Part of U.S. patent application Ser. No. 11/856,813, filed Sep. 18, 2007, which claimed priority from and included a certified copy and translation of Venezuelan patent application 06-02147, filed in Venezuela on Sep. 18, 2006, all of which are incorporated herein by reference.

BACKGROUND OF THE INVENTION

1. Field of the Invention

The present invention relates to the removal of contaminants from industrial used lubricating oils and used motor oils by treatment of the used oil with clay at high temperatures, but at lower temperatures than that of "cracking", and later removing the contaminated clay by filtration and centrifugation.

2. Description of the Prior Art

The recycling of used lubricating oils coming from industrial processes, car motors, transmissions and other sources is an important process, because it avoids contamination by lubricating oils, and allows the recovery of lubricating base oils, which are a scarce product. The oils form a monomolecular layer on the surface of the water, which it means that a small quantity of oil can contaminate a great volume of water.

The recovered lubricating oil bases have all the properties of the first refining, and they can be used to produce new oils. The recycling process can be done several times.

The contaminants in industrial oils, besides water, are usually iron, chromium, cadmium, nickel, copper, calcium, barium, zinc, aluminum, and phosphorus. Motor oils also have soot, contaminants due to degraded additives, and other contaminants coming from the gasoline, and for that reason they are more difficult to be re-refined.

Several techniques have been used to re-refine used oils, mainly by distillation and treatment with chemical reactives to precipitate the coagulants (principally sulfuric acid and other solvents, which are also contaminants that produce environmental problems).

The treatments with clays at very high temperature have the problem that the later separation becomes difficult because the pores of the felt (cloths, cellulose, synthetic materials or others) of the filter press become plugged, mainly due to soot, colloidal coal, and organic compounds.

The distillation systems require large investments, and the re-refining cost is usually expensive. This is also the case of the other used treatments with sulfuric acid, sulfates, phosphates and other chemicals, which are difficult to extract later on. For example in the separation of sulfuric acid with clays there is the inconvenience of the great production of sludge, besides the large volumes of corrosive acids and the great lost of used original oils. It is necessary to take into account that the pre-heating of the mixtures must not be higher than 250° C. to 300° C., if one wants to avoid the "cracking" of the lubricating oils. (Excessive heat causes hydrocarbon chains in the oil to "crack" and break into smaller chains, which are not suitable for lubricating oil, though they may be suitable for fuel oil.) Other more economic systems use inorganic catalysts mixed with clays in continuous feeding systems.

U.S. Pat. No. 3,625,881, issued on Dec. 7, 1971, to John M. Chambers and Herbert A. Hadley, discloses a process for reclaiming lubricating oils, including flash vaporization to remove water, mixing the used oil with a hydrocarbon oil, using a centrifuge to remove solid precipate, and two fractional distillations. The instant invention is distinguishable, in that in it the used oil is mixed with clay rather than another oil.

U.S. Pat. No. 3,639,229, issued on Feb. 1, 1972, to Darrell W. Brownawell and Remi H. Renard, discloses a process of refining used lubricating oils, in which the used oil is mixed with aliphatic alcohol. There may be a final clay treating step (see claim 9). The instant invention is distinguishable, in that it does not require the use of alcohol.

U.S. Pat. No. 3,819,508, issued on Jun. 25, 1974, to Morton Fainman and Charles Stouse McCauley, discloses a method of purifying lubricating oils, in which the oil is mixed with a predominantly hydrocarbon liquid diluent, then with an alcohol and water mixture, and centrifuging is used to remove sludge and metal compounds. The instant invention is distinguishable, in that in it the used oil is mixed with clay.

U.S. Pat. No. 3,919,076, issued on Nov. 11, 1975, to Louis E. Cutler, discloses a process for re-refining used automotive lubricating oil, including treatment with a saturated hydrocarbon solution, followed by vacuum distillation, followed by catalytic hydrogenation, which are not required in the instant invention.

U.S. Pat. No. 3,930,988, issued on Jan. 6, 1976, to Marvin M. Johnson, discloses a process for reclaiming used motor oil using an aqueous solution of ammonium sulfate or bisulfate, that is not required in the instant invention.

U.S. Pat. No. 4,033,859, issued on Jul. 5, 1977, to Donald Douglas Davidson and Bjorn I. Engesvik, discloses thermal treatment of used petroleum oils under pressure at temperatures to above about 400 to 800 degrees Fahrenheit (or 190 to 412 degrees Celsius). Although there may be a small overlap in the temperature range, the instant invention does not require pressure during its heating step.

U.S. Pat. No. 4,383,915, issued on May 17, 1983, to Conrad B. Johnson, discloses a clay contacting process for removing contaminants from waste lubricating oil, in which the oil is contacted with decolorizing clay at a temperature in the range of 650 to 725 degrees Fahrenheit (or 329 to 370 degrees Celsius). The instant invention is distinguishable, in that it uses a lower temperature range.

U.S. Pat. No. 4,502,948, issued on Mar. 5, 1985, to Donald C. Tabler, discloses a procedure for treating demetallized used oil using an acid such as sulfuric acid. In the instant invention, no sulfuric or other acid is used.

U.S. Pat. No. 5,112,479, issued on May 12, 1992, to Vichai Srimongkolkul, discloses an oil purification unit with a cyclonic (centrifuge) reservoir section and a filtration section. The second embodiment of the instant invention is distinguishable, in that in it the oil is first mixed with clay before being centrifuged.

U.S. Pat. No. 5,288,413, issued on Feb. 22, 1994, to Humbert H. Chu, discloses treatment of a waste sludge to produce a non-sticking fuel, using a vacuum or pressure, neither of which are required by the instant invention.

U.S. Pat. No. 5,759,385, issued on Jun. 2, 1998, to Marcel Aussillous et al., discloses a process and plant for purifying spent oil, including vacuum distillation, which is not required by the instant invention.

U.S. Pat. No. 5,968,370, issued on Oct. 19, 1999, to Mark E. Trim, discloses a process for removing hydrocarbons bound to solid particles in contaminated sludge, such as from oil refineries, supertankers, and drill cuttings. A treatment fluid is applied, comprising water, a silicate, a nonionic surfactant, an anionic surfactant, a phosphate builder and a caustic compound. Later, the treatment fluid is removed, to be used again. In the instant invention, the products to be treated are different, namely lubricating oils contaminated with small amounts of metals and other products, as a result of their use as lubricants. In the instant invention, only clay is used; no fluid treatment is used, and no treatment fluid is recovered, but only the lubricating oils themselves.

U.S. Patent Application Publication No. 2002/0166794, published on Nov. 14, 2002, to Alexander P. Bronhstein, Moshe Gewertz and Vladimir M. Rozhansky, discloses a process for producing standard and used fuels from lubricating oils and several other waste products. It produces a mixture of water and other products to be added to petroleum-based waste. Later, dewatered matter is skimmed, and what remains is processed by thermocatalytic cracking. The instant invention produces a lubricating oil basis (not fuel) from used lubricating oils. In the instant invention, no water as a carrier of products is used. Instead, most of the water is taken out by methods such as decanting and heating, before treatment with clay in the reactor. In the instant invention, no skimming of a watered mixture is performed, nor is thermocatalytic cracking used, thus it has a final product different from that of Bronhstein et al. Instead of fuel products, it obtains a lubricating oil basis, which can be used to obtain new lubricating oil by adding appropriate additives.

U.S. Patent Application Publication No. 2006/0000787, published on Jan. 5, 2006, to Louis Galasso III et al., discloses purification of impure oil by centrifugation, without first mixing the oil with clay as in the instant invention.

Japanese Patent No. 2-4898, published on Jan. 9, 1990, to Kyoho Seisakusho and Toyota Jidosha, discloses a process of reclaiming lubricating waste oil, including a thermal reaction treatment in which an aqueous solution of caustic alkali is added to the oil, a centrifugation process after diatomaceous earth and activated clay are added to the oil, and a filtration process. The instant invention is distinguishable, in that it does not require that the addition of a solution of caustic alkali to the oil.

French Patent No. 2 690 924, published on Nov. 12, 1993, to Virgulino Antonio Digilio, discloses a method of re-cycling of used or contaminated lubricating oils, including adding clay to the oil in a reactor, and also adding water containing a dissolved sulfur based catalyst and filtration aid. The instant invention is distinguishable, in that it does not require adding water containing a catalyst. Dr. Pablo Martin de Julian, the first named inventor herein, has corrected the machine translation provided by the Examiner in the parent application, and this corrected translation is submitted with the present application.

Page 10, lines 4-5 of the English translation of Digilio submitted herewith states that it uses "a catalyst based in diluted active sulfur and the addition approximately 2% of auxiliary of filtration, such as the diatomite", but the present invention does not use any of these things. Likewise, in Tabler (U.S. Pat. No. 4,502,948 supra), sulfuric acid is added to the oil.

The process of centrifugation in the present invention is fundamentally different from the process of centrifugation disclosed in Digilio. The present invention uses a centrifuge to separate clay that has absorbed soot (i.e., colloidal hydrocarbons) from the rest of the mixture comprising oil and clay that has absorbed other contaminants (e.g., metals). Page 8, lines 35-36 of the English translation states that centrifugation "eliminates a considerable quantity of water before containing dissolved salts, carbon deposits and nonsoluble sediments." Because of this important difference between these processes, the stage where centrifugation is performed is also different. In Digilio, centrifugation is performed at the beginning, while in the present invention it is performed near the end before the filter press procedure. In the present invention, centrifugation is performed with the mixture of oil, clay and contaminants, while in Digilio the contaminated oil is centrifuged before the clay is added.

In summary, the main differences between the present invention and the prior art are as follows:

In the process of the present invention, the decontamination with the clay is performed in an open reactor at atmospheric pressure. In contrast, Digilio has to use an autoclave, because he has to work with a high pressure of $58.8399\times10^4$ to $98.0665\times10^4$ Pascals in part of the process, and also to use a partial vacuum by applying from time to time a low pressure of $7.3326\times10^4$ Pascals (see page 10, line 13 of the English translation and page 12, lines 33-34 of the original French). The process of the present invention is both simpler and less expensive, because autoclaves are much more expensive than open reactors.

In the present invention, the clay used to decontaminate the used lubricating oil acts on the oil free of water, as any water in the original used oil is removed by the flash distillation before the clay is put in contact with the oil and its contaminants, and water is never added. By contrast, in Digilio, water with "a catalyst based in diluted active sulphur" and an "auxiliary of filtration, such as the diatomite" is added to the oil and clay (see page 10, lines 3-4 of the English translation). This is critical, because the efficiency of the clay in decontaminating is much greater when the oil is free from water, and decreases rapidly when water is present.

*Clay Amended Soilless Substrates: Increasing Water and Nutrient Efficiency in Containerized Crop Production* by James Stetter Owen, Jr. (2006) does not disclose the use of clay for cleaning used lubricating oils, as in the instant invention.

None of the above inventions and patents, taken either singly or in combination, is seen to describe the instant invention as claimed.

We can summarize the prior art process for recovering used lubricating oil as having three parts or stages:

First there is the adaptation or preparation process, which consists in the separation of solids and water, usually by filtration and flash distillation, respectively, or other process.

In a second stage there is a treatment to eliminate the contaminant products, such as metals, soot, organic refuse, additives, oligogenic compounds, etc. This elimination process is done: i) by chemical methods, such as adding sulfuric acid, calcium sulfate, hydroxides, phosphoric acid, etc.; ii) by physical-chemical methods as vacuum distillation; or iii) by other methods.

The third stage is the process of whitening and taking out the smell. Here there are also use different methods, but the most common is the use of clay or activated carbon.

The present invention has important advantages with respect to these processes.

SUMMARY OF THE INVENTION

The main difference of our method compared with the prior art, is that the second and third stages are integrated in a unique process using only clays, and there is not any chemical process or vacuum distillation. In this way there are only two processes or stages: the first one and a second one using only clays. Filtering, as in the prior art, performs the separation of the clays from the recovered lubricating oil. Filtering is adequate for industrial used lubricating oil. However for used lubricating oil with contaminant soot, as in the case of used oil coming from the cars and other vehicles, the soot usually plugs the pores of the filters, and it is necessary to use an additional centrifugation process in order to avoid this problem.

In our search for a process for the recovery of used lubricating oils that was economic and did not require high investments, a fact to be considered appeared immediately. It was necessary to separate the treatment of industrial oils, with mainly watery and metallic contaminants, from those with organic contaminants and soot, such as those coming from the internal combustion motors. For this reason, the present invention has two preferred embodiments: the first for recovery of used industrial lubricating oils, and the second for recovery of oils coming from internal combustion motors (including used lubricant oils of explosion and diesel motors, automatic transmissions, and in general, every kind of oils coming from filling and service stations for cars).

The first preferred embodiment of the present invention is suitable for used industrial oils, and it includes the steps of: (a) Mixing the used lubricating oils with clay in a reactor, and heating the mixture to temperatures from 105° C. to 200° C., in a batch type system. The temperatures are low enough that the cracking of the lubricating oils in the mixture does not take place or at least is minimized. (b) Keeping the mixture of clay and used lubricating oil for a certain residence time in the reactor. (c) Filtration by a system of filter presses, wherein the clay sticks to the filtering cloths, and the filtered oil goes through free of impurities. This system is shown in FIG. 1, which corresponds to the first preferred embodiment.

An important observation in this process is that, if this is performed in a continuous way, with feeding of used oil and preheated clay through the bottom of the reactor and gathering of recovered oil from the upper side, then the oil still contains a large amount of contaminants, and is not suitable for future use. In continuous systems in the prior art, they use catalysts or chemical reactants to obtain suitable results, which complicate and increase the cost of the process.

On the other hand, it is important also to point out that the amount of water contained in some oils is high, and in these cases before adding the clay it is convenient to eliminate the water with a "flash" distillation process from 80° C. to 100° C., prior to treatment with the clay.

The second preferred embodiment of the invention is designed for the removal of metallic contaminants, soot and organic contaminants from the used lubricating oils coming from automotive market. It includes the steps of: (a) Mixing the used lubricating oils with clay in a reactor, and heating the mixture to temperatures from 105° C. to 200° C. Again, the temperatures are low enough that the cracking of the lubricating oils in the mixture does not take place or at least is minimized. (b) Keeping the mixture of clay and used lubricating oil is for a certain residence time in the reactor. (c) Using a centrifuge to separate a large part of the oils to be recovered from the clay containing organic and metallic contaminants. (c) Filtration of the oils coming from the centrifuge, by passing them through a filter press as described above for the industrial used oils. The second preferred embodiment is illustrated in FIG. 2.

For both embodiments, the heating system that was found most economic for the process of the present invention consists of a boiler heated with gas and a transference fluid (e.g., hydraulic oil), which carries the heat from the boiler to a heating jacket in the reactor containing the used oil and clay. The heating is done by conduction. The used lubricating oils are loaded in the reactor with movable and diaphragm electric pumps, or by gravity. Before the used oils are placed into the reactor, they may be passed through a gross filter (for instance, 200 mesh) to remove large particles. After passing them through the gross filter, there can also be a flash distillation from 80° C. to 120° C. to remove excessive quantities of water. Next, the right amount of clay is added, and after some residence time determined by the type of oil and laboratory analysis, the mixture in the reactor is discharged. During the residence time the clay reacts with the contaminants, creating chemical bonds between them. For this, it is necessary to have good control of the temperature (in order to avoid cracking the oils) and of the amount of clay and the residence time in the reactor. All these conditions are previously determined by the laboratory analysis. After that the filtering process is performed.

Accordingly, it is a principal object of the invention to provide an improved process for recycling industrial lubricating oils.

It is another object of the invention to provide an improved process for recycling automotive lubricating oils.

It is a further object of the invention to reduce pollution to the environment from discarded used lubricating oils.

Still another object of the invention is to reduce the depletion of nonrenewable resources used in making lubricating oils.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention an improved process for recycling used lubricating oils, having two preferred embodiments.

Figure 1:
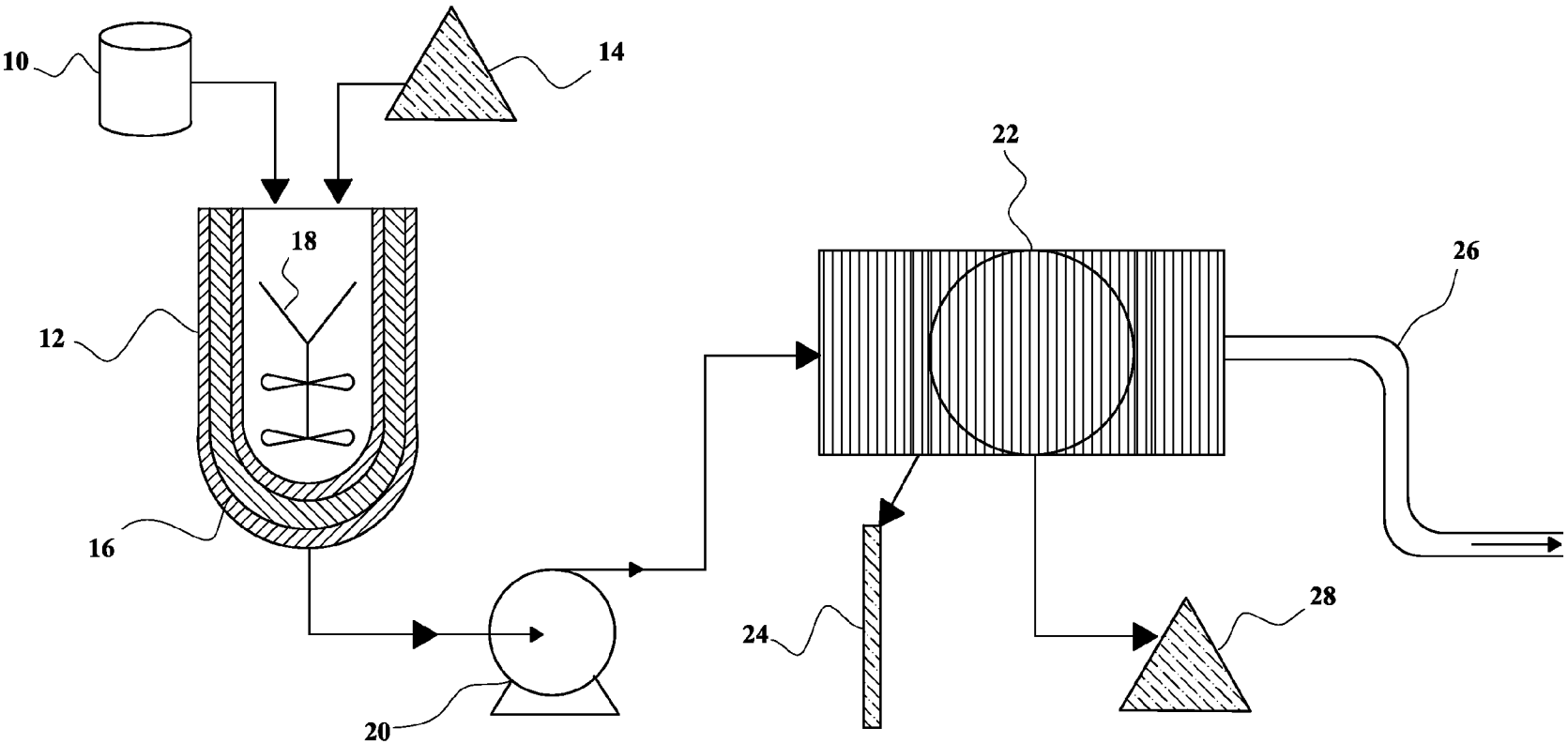
FIG. 1 is a schematic diagram of the first preferred embodiment of the invention.

FIG. 1 depicts the first preferred embodiment of the process of the invention, which is its simplest form. The concept discussed is a "batch" or "semi-batch" type process, wherein the used contaminated lubricating oil 10, which may be filtered before going to the reactor 12, is mixed with activated clay 14 to high temperature, obtained by means of a heating jacket 16 in the reactor. The reactor is open, and therefore the reaction takes place at normal atmospheric pressure. As neither high pressure nor a vacuum is required, as in the prior art, the expense of an autoclave is avoided. Before loading the reactor, it may be desirable to perform a flash distillation, to eliminate the water that is coming with the used oils, as well as a pre-filtration to eliminate contaminants of large size. To maintain the temperature of the heating jacket, hot hydraulic oil can be used as a heat transference fluid, which is heated in a boiler (not shown in the drawings). The operation of mixing oil with clay and heating can be done in a continuous way, but the best results are obtained with the "batch" or "semi-batch" non-continuous system. The reactor, where the interaction between the clays and the oil to be recovered is taken place, usually has stirring rods 18, which allow a faster process and decrease the residence time. The residence time can be from several minutes to several hours, depending on the type of oil and contaminants, but is preferably from five to fifteen minutes. The mixture should be heated in the reactor to a temperature of from 105 degrees Celsius to 200 degrees Celsius, preferably not more than 150 degrees Celsius, more preferably not more than 120 degrees Celsius, most preferably not more than 110 degrees Celsius. The volume of the clay is preferably lower than 60% of the volume of the used lubricating oil, and is most preferably from 2% to 25% of said volume. From the reactor, the heated oil-clay mixture is pumped using pump 20 through a filter press 22 where the clay and trapped contaminants are separated from the oil. The clay is left in the filters 24 as a "cake", and the recovered oil without contaminants is carried out to a pipe system 26, which retake the filtered oil from the filter press. After loosening the filtered frame with its filters, the clay cake sticks to the filters, but is separated from them, in order to recover the filters, leaving the clay as waste material 28. (The metals in the used clay may make it useful in making cement.) The recovered oil, now without contaminants, can be used as lubricating base oil.

Figure 2:
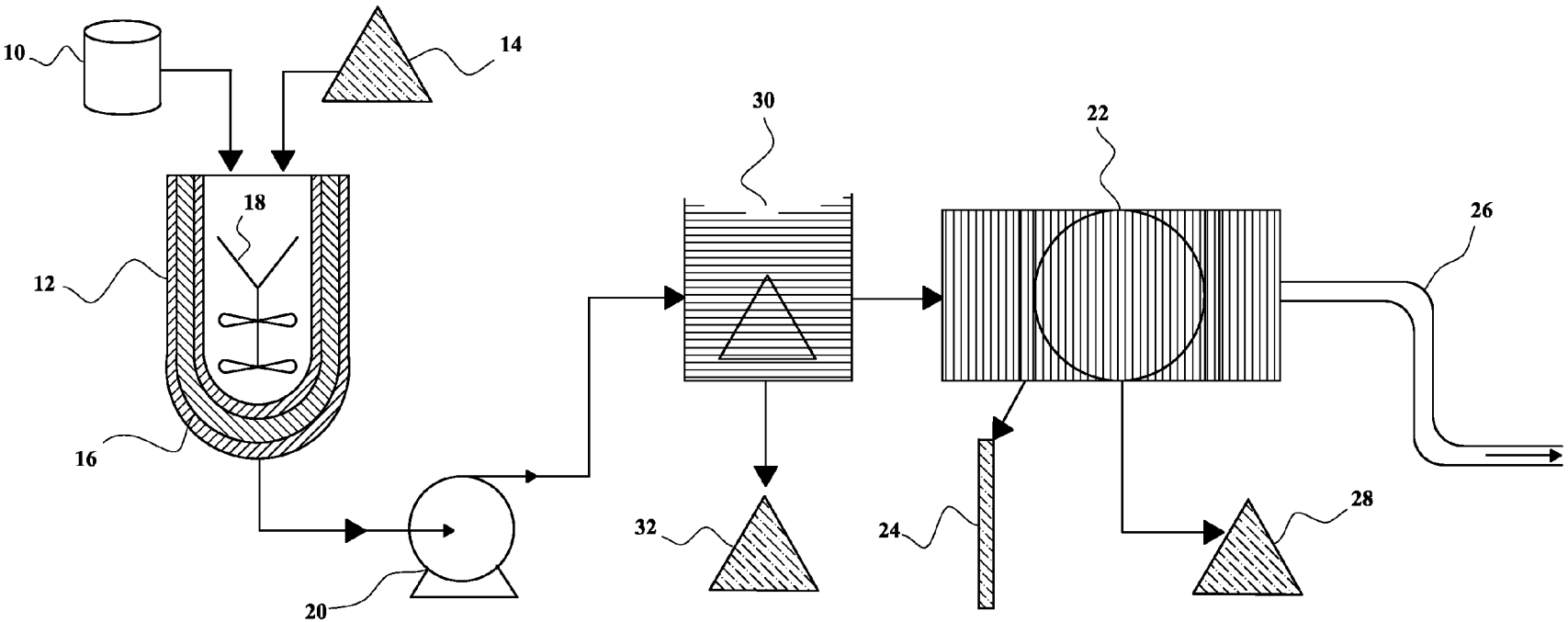
FIG. 2 is a schematic diagram of the second preferred embodiment of the invention.

In FIG. 2, showing the second preferred embodiment of the invention, the process is similar to that depicted in FIG. 1, but now there is an industrial centrifuge machine 30 between the reactor12 and the filter press 22. The reason for this centrifugal system is that for the used oils coming from explosion motors, an important contaminant is the soot, which comprises very small particles of carbon and other organic compounds, such as the additives of the lubricants. The problem with these contaminants is that when they are taken directly to the filter press, they plug the pores of the filter felts (cloths, cellulose, synthetic, etc.), stopping or decreasing very strongly the filtered flow. It is for this reason that a centrifugal operation is needed prior to filtration, in order to remove most of the clay contaminated with soot 32, in order to allow a filtered operation later without problems.

The system described in FIG. 1 is suitable for the recovery of industrial oils with low or no contamination with soot or organic products, and the system described in FIG. 2 is mainly appropriate for used oils coming from cars and motor vehicles, where there is a high percentage of soot contamination. However, this more complete second system can be also used for industrial oils or any kinds of used oils, e.g., oil used in internal combustion motors, or in industrial or other motors.

The inventors have noticed that oils that had a low water content were easier to clean. It occurred to them that rather than following the prior art process of adding water and acid, along with clay, to used lubricating oils during the recovery process, clay could be used by itself. Flash distillation is used in the process that is the subject of the present patent application, solely for the purpose of removing water from the used lubricating oil before it is treated with the clay to remove contaminants other than water. Clay is then added to the used lubricating oil, without the use of other substances, and the mixture is heated at a temperature great enough, and for a period long enough, for the clay to absorb contaminants from the used oil. This new process has the advantage that less heat is required, thus both reducing energy costs and improved the quality of the recovered oil by reducing thermal cracking of long hydrocarbon chains in the oil. This new process also has the advantage that it can be performed at atmospheric pressure, thus further reducing energy costs and eliminating the expense of autoclaves required in the prior art, which requires high pressure for the reactions to take place that clean the oil.

Clay has what are called "active centers". Clay, as it comes from the earth, is washed with water and acid, to remove contaminants from the active centers, then dried. This is called "activated clay" because the active centers are now free to bind other contaminants This is conceded to be in the prior art. Untreated clay may be used in the present invention, but it is more efficient to use activated clay. The activation of clay is not part of the claimed process, and is done before the claimed process. No acid is used in the claimed process.

The present invention differs from the prior art in that in it, only clay is mixed with the used lubricating oil. This is possible, because flash distillation has been used to remove water from the active centers in the clay, so that contaminants in the used lubricating oils can bind to the active centers in the clay. While this may seem obvious to try, the use of clay only is not disclosed in the prior art, and it has the critical advantage that it enables treatment of the oil at lower temperatures, thus reducing cracking (i.e., breaking of long hydrocarbon chains by heat) and thereby resulting in a higher quality of recovered oil.

Once the recovered bases are obtained, the corresponding analysis has to be performed in order to determine that the amount of contaminants is below the desired level, as well as to determine the characteristics of the recovered base lubricating oils, such as their viscosity, total basic number (TBN), flash point, etc.

The following examples are given for illustration:

EXAMPLE 1

A treatment of 1,800 liters of used oil of industrial origin was performed, to show the effectiveness of the present invention.

Process of Recovery of Used Industrial Oils

(Example Industrial Plant)

Materials.

1,800 liters of lubricating oils for industrial gears coming from Carbonorca Enterprise C.A.

Initial Characteristics of the Used Oils.

1. Color: Opaque brown, non-translucent.
2. Presence of free water and/or in emulsion: (10-50% v/v).
3. Presence of solid suspended particles (>1000 mg/Kg, 0-30% v/v)
4. pH: >7
5. Aromatics: <1 mg/Kg.
6. Solvents: 0-10% v/v.

System of Absorbent/Adsorbent.

Activated clays, hybrid type of hormite and smectite, with acid characteristic, with pH (5% solids diluted in $H_2O$) equal to 2.5-3.0, density of 336-416 g/l, and particle size, by sieve analysis (Tyler Standard), particles with sizes less than 150 μm: 100%, and particles with sizes less than 45 mm: of 73-76%.

Procedure Description.

1) Pre-filtration: The used industrial oil goes through mobile filtering equipment to eliminate big particles that could be present in the oils. Polyester sleeve filters with holes of 10-100 microns were used.
2) Reactor load: Mobile pumps were used for the process of loading the 1800-liter batch.
3) Distillation flash: The oil was heated with a system of thermal oil recirculation coming from a boiler, with the aim of eliminating the water and the residual part of the solvents. The temperature reached oscillates between 105-115° C., measured and controlled with instruments installed in the reactor (i.e., thermocouples and flow control valves). Time of heating averaged two hours. In this stage the oil is recirculated and there is a continuous mechanical stirring. Once the distillation temperature is reached and the water eliminated, a crackling test (ECC001) is performed to be sure that there is no water remaining.

4) Absorption/Adsorption Process: Once the crackling test is performed, the absorbent/adsorbent elements, namely the clays, are added in the reactor. The amount to be used is determined previously by the laboratory tests. The addition of these different elements varies between 0.5-2% v/v for a batch of 1800 liters. (By "v/v" is meant the volume of clay divided by the total volume of the mixture in the reactor.) For lower loads of this amount and/or more contaminants the clays added could be in the range of 2-5% v/v. There is stirring during the addition of the clays, and once they are added, the stirring continues simultaneously with the recirculation to get an optimums contact between the oil and clay. This process lasts for a period of five to fifteen minutes. (Note that absorption means drawing into the interior of the clay particles, adsorption means attachment to the surface of the clay particles, and absorption and adsorption are collectively referred to as "sorption".)

5) Filtration Process: Once the period of clay-oil mixture is finished, the filtration process is started. This is performed with a filter press of vertical plates provided with a series of 100% cotton cloths with openings between 10-40 microns and a 100% cellulose filter of 8-20 micron holes. The operation pressures are 30-100 psi at the entrance of the filter and 10-15 psi at the exit. The amount of solid particles in the filtration process is analyzed to guarantee that the final oil does not contain any solids.

Once the removal of contaminants is finished the procedure is:

1) Passing the recovered lubricating base oil to the observation tank (checking previously that there are not solid particles). The observation tank has a preventive function, since it enables the determination of the location of any possible contamination with solid particles or high levels of metals, if the removal process becomes inefficient for any reason.

2) There is a metallic characterization by the method of atomic absorption to determine if the product is good to be used to produce lubricants.

3) Once the two preceding steps are done, viscosity and viscosity index are determined with the aim of storing in lubricating plant tanks, to decide which kind of use will be assigned. There is a pumping system connected to a series of pipes and valves, wherein the recovered lubricating base oils go through post-filters, to insure that there is not any type of residue or solid particle.

Table 1 shows the analysis of properties of industrial used oil:

TABLE 1

Initial Properties of Used Oil Before the Process

| Parameter | Unit* | Value | Method |
|---|---|---|---|
| Cadmium and composites | mg/Kg | <0.10 | ASTM D 5185 |
| Chromium and composites | mg/Kg | 14.4 | ASTM D 5185 |
| Soluble copper composites (salts and acids) | mg/Kg | 22.1 | ASTM D 5185 |

TABLE 1-continued

Initial Properties of Used Oil Before the Process

| Parameter | Unit* | Value | Method |
|---|---|---|---|
| Nickel and composites (salts and acids) | mg/Kg | 3.51 | ASTM D 5185 |
| Lead and composites (salts and oxides) | mg/Kg | 534.9 | ASTM D 5185 |
| Vanadium and composites (salts and oxides) | mg/Kg | 8.9 | ASTM D 5185 |
| PCBs | ppm | <0.10 | HGPC |
| Sediments | ml/L | <0.10 | ASTM D 473 |
| $R^2$-Cl** | ppm | 800 | 9077 |
| Cinematic Viscosity to 100° C. | cSt | 18.6 | |
| Density | g/cm$^3$ | | ASTM D 1298 |
| Flash Point | ° C. | 195 | NVC 372 |
| $H_2O$ by distillation | % p/v | 0.00 | ASTM D95 |
| Total Sulfur | % p/p | 0.60 | ASTM D 1552 |

*1 mg/Kg = 1 ppm

** $R^2$-Cl = Organic Radical

Table 2 presents the properties of the recovered lubricating base oils obtained through this process:

TABLE 2

Final Properties of Recovered Oil (Lubricating Bases) After the Process

| Parameter | Unit | Specification | Obtained value | Method |
|---|---|---|---|---|
| Flash Point Method of open cup | ° C. | 210-260 | 219 | Covenin 372 |
| Cinematic Viscosity to 100° C. | cSt | 15-19 | 17.4 | Covenin 424 |
| Viscosity Index | | 90 | | Covenin 889 |
| Calcium | ppm | <0.01 | 0.005 | Covenin 2044 |
| Magnesium | ppm | <0.014 | 0.009 | Covenin 2044 |
| Zinc | ppm | <0.1 | 0.02 | Covenin 2044 |
| Crepitating, crackle | | S/N | Negative | Covenin |
| Specific Gravity to 15.6° C. | g/ml | 0.8685 | 0.8703 | Covenin |
| Amount of clay | | S/N | Negative | Method EC-B05 |

EXAMPLE 2

A laboratory experiment was performed, with a sample of used motor oil. The following is a description of the details of the experiment:

Materials:

800 ml of used oil, coming from a Fiat "Ritmo" car, 1987 model, 1600 ml motor, with 45 days of running, and a total of 55,000 km passed over. The original oil was PDV (Petroleum of Venezuela) brand, 20 W-50 W multigrade (Experiment No. 1). There was also used 800 ml of a mixture of used oils coming from an workshop for oil change, located in Maracay, Aragua State-Venezuela (Experiment No. 2).

System of Absorbent:

Activated clays, hybrid type of hormite and smectite, with acid characteristic.

Experimental Process and Preparation of Samples for Analysis:

A sample of 800 grams of used motor oil was put in a glass beaker, with a magnetic stirrer inside, and was placed on an electric heating plate with continuous magnetic stirring.

The heating of the sample was between 100-120° C. during 30 minutes, in order to eliminate the water, until the crepitating or crackling test was negative. The amount of clay was prepared in approximately 20% m/m of used oil. (By "m/m" is meant the mass of the clay divided by mass of the used oil.) The oil was added with stirring of 800 to 1200 rpm, during one hour, and reaching temperatures of 180° C.

The mixture oil-clay was passed through a filtration process at vacuum with a Buchnner funnel, using two cycles of filtering: first with 35 mesh, and second with Watman No. 5 cellulose. In this way, the contaminants retained with the clay are separated from the filtered oil.

Tables 3 and 4 show the results obtained, giving the characteristics of the used oils in the experiments, and the recovered lubricating base oils after applying the experimental procedure.

TABLE 3

Initial Properties of the Used Motor Oil

| Exp. Number | Flash point (° C.) | Density (gr/ml) | μ (cSt) 100° C. | Metals (ppm) Ca | Mg | Zn | Fe | Cu | Al | Color | Odor |
|---|---|---|---|---|---|---|---|---|---|---|---|
| 1 | 203 | 0.81 | 13.2 | 1768 | 112 | 841 | 98 | 3 | 17 | Dark brown | Burned oil |
| 2 | 183 | 0.83 | 14.9 | 1826 | 129 | 972 | 96 | 5 | 12 | Dark black | Burned oil |

TABLE 4

Final Properties of the Recovered Motor Oil After the Process

| Exp. Number | Flash point (° C.) | μ (cSt) 100° C. | Metals (ppm) Ca | Mg | Zn | Color | Odor |
|---|---|---|---|---|---|---|---|
| 1 | 196 | 11.2 | 50.2 | 3.1 | 12.4 | Light brown to yellow | Lubricating base oil |
| 2 | 180 | 12.8 | 45.6 | 4.1 | 23.2 | Reddish chestnut | Lubricating base oil |

CONCLUSION

The laboratory tests have shown that with the process described, a removal takes place of metallic and organic contaminants of used industrial lubricating oils and those oils coming from internal combustion motors. The level of removal is such that the recovered lubricating oil bases can be used again with confidence in motor oils, automatic transmissions and other required uses. Our system is simple and economic compared to other systems, and the quality of the recovered oils is similar. Note that in our system, only clay (without the use of other substances) is used to remove contaminants from the oil.

It is clear that the process and the product of the present invention will find wide use in the recovery and recycling of used industrial oils as well as those oils coming as wastes from internal combustion motors and transmissions. The foregoing describes only some embodiments of the present invention and obvious modifications to those skilled in the art can be made thereto without departing from the scope of the invention. It is to be understood that the present invention is not limited to the embodiments described above, but encompasses any and all embodiments within the scope of the following claims.

We claim:

1. A process for recovering used lubricating oil, comprising the steps of:

a) selecting used lubricating oil;

b) pre-filtering the used lubricating oil;

c) pre-treating the used lubricating oil with a flash type distillation, to take out substantially all water from the original used lubricating oil;

d) placing used lubricating oil and clay in an open container where they are put together in contact to form a mixture, at normal atmospheric pressure;

e) heating the mixture to a temperature of from 105 degrees Celsius to 200 degrees Celsius; and f) removing and separating the lubricating oil from waste products containing the clay and contaminants of the used lubricating oil, using a filter press system to separate the lubricating oil from the clay and contaminants, to form a clay cake that is discarded, obtaining oil essentially free from contaminants, without bringing substances other than clay in contact with the used lubricating oil.

2. The process for recovering used lubricating oil according to claim 1, wherein the mixture is heated to a temperature of no greater than 150 degrees Celsius.

3. The process for recovering used lubricating oil according to claim 1, wherein the mixture is heated to a temperature of no greater than 120 degrees Celsius.

4. The process for recovering used lubricating oil according to claim 1, wherein the mixture is heated to a temperature of no greater than 110 degrees Celsius.

5. The process for recovering used lubricating oil according to claim 1, wherein the mixture is heated with a system including a heating jacket, wherein hot heating fluid circulates to transfer heat.

6. The process for recovering used lubricating oil according to claim 1, wherein the clay is a hybrid of hormite and smectite.

7. The process for recovering used lubricating oil according to claim 1, wherein the container is a reactor, heating fluid comes from a boiler, and a residence time in which the mixture remains in the reactor varies from five to fifteen minutes according to the type of used lubricating oil.

8. The process for recovering used lubricating oil according to claim 1, wherein stirring rods are used to decrease the residence time of the mixture in the container.

9. The process for recovering of used lubricating oil according to claim 1, wherein the volume of the clay is lower than 60% of the volume of the used lubricating oil.

10. The process for recovering used lubricating oil according to claim 1, wherein the volume of clay is from 2% to 25% of the volume of the used lubricating oil.

11. A process for recovering used lubricating oil, comprising the steps of:

a) pre-treating used lubricating oil with a flash type distillation, to take out substantially all water from the original used lubricating oil;

b) placing the used lubricating oil and clay in an open container where they are put together in contact to form a mixture, at normal atmospheric pressure;

c) heating the mixture to a temperature of from 105 degrees Celsius to 200 degrees Celsius;

d) centrifugating the mixture to separate from the mixture a portion of the clay that has absorbed soot from the used lubricating oil;

e) removing the portion of the clay that has absorbed soot from the used lubricating oil; and f) removing recovered oil from the clay remaining in the mixture using a filter press;

wherein the process is performed without bringing substances other than clay in contact with the used lubricating oil.

12. The process for recovering used lubricating oil according to claim 11, wherein the mixture is heated to a temperature of no greater than 150 degrees Celsius.

13. The process for recovering used lubricating oil according to claim 11, wherein the mixture is heated to a temperature of no greater than 120 degrees Celsius.

14. The process for recovering used lubricating oil according to claim 11, wherein the mixture is heated to a temperature of no greater than 110 degrees Celsius.

15. The process for recovering used lubricating oil according to claim 11, wherein a filter press system is used to separate the lubricating oils from the clays and contaminants, to form a clay cake that is discarded, obtaining oil essentially free from contaminants.

16. The process for recovering used lubricating oil according to claim 11, wherein the centrifuge is an industrial centrifugal machine.

17. The process for recovering used lubricating oil according to claim 11, wherein the centrifuge has a rotating screw, which allows it to separate most of the clay from the lubricating oil to be recovered.

18. The process for recovering used lubricating oil according to claim 11, wherein the container is a reactor, heating fluid comes from a boiler, and a residence time in which the mixture remains in the reactor varies from five to fifteen minutes according to the type of used lubricating oil.

19. The process for recovering of used lubricating oil according to claim 11, wherein the volume of the clay is lower than 60% of the volume of the used lubricating oil.

20. The process for recovering used lubricating oil according to claim 11, wherein the volume of clay is from 2% to 25% of the volume of the used lubricating oil.

* * * * *